US008967413B2

(12) United States Patent
Tinstman et al.

(10) Patent No.: US 8,967,413 B2
(45) Date of Patent: Mar. 3, 2015

(54) VACUUM LID FOR USE WITH BABY FOOD JARS

(71) Applicant: Scandinavian Child LLC, Raleigh, NC (US)

(72) Inventors: Michael D. Tinstman, Malden, MA (US); John D. Fiegener, Marblehead, MA (US)

(73) Assignee: SCAC LLC, Milford, CT (US)

( * ) Notice: Subject to any disclaimer, the term of this patent is extended or adjusted under 35 U.S.C. 154(b) by 0 days.

(21) Appl. No.: 13/621,948

(22) Filed: Sep. 18, 2012

(65) Prior Publication Data

US 2013/0068650 A1 Mar. 21, 2013

Related U.S. Application Data

(60) Provisional application No. 61/536,627, filed on Sep. 20, 2011.

(51) Int. Cl.

| | |
|---|---|
| ***B65D 51/16*** | (2006.01) |
| ***B65D 81/20*** | (2006.01) |
| ***B65B 31/04*** | (2006.01) |

(52) U.S. Cl.

CPC ..... *B65D 81/2038* (2013.01); *B65B 31/04* (2013.01)

USPC ..... 220/231; 220/203.07; 220/203.11; 206/524.8; 215/262; 215/260; 141/65

(58) Field of Classification Search

USPC ..... 220/231, 203.04, 203.07, 3.11, 203.15, 220/212, 23.11; 206/524.8; 215/262, 260, 215/270, 311, 288; 141/65, 27

See application file for complete search history.

(56) References Cited

U.S. PATENT DOCUMENTS

| | | | | |
|---|---|---|---|---|
| 2,907,485 | A | | 10/1959 | Lunden |
| 3,313,444 | A | | 4/1967 | Katell |
| 3,943,987 | A | | 3/1976 | Rossi |
| 4,218,967 | A | | 8/1980 | Batchelor |
| 4,278,114 | A | * | 7/1981 | Ruberg ..... 141/65 |
| 4,372,096 | A | | 2/1983 | Baum |
| 4,660,355 | A | | 4/1987 | Kristen |
| 4,763,802 | A | | 8/1988 | Johnston |
| 4,889,250 | A | | 12/1989 | Beyer |
| 5,121,590 | A | | 6/1992 | Scanlan |
| 5,195,427 | A | | 3/1993 | Germano |
| 5,294,010 | A | * | 3/1994 | Tschida ..... 215/228 |
| 5,347,918 | A | * | 9/1994 | Chen ..... 99/472 |
| 5,396,751 | A | | 3/1995 | Chi |
| 5,398,811 | A | | 3/1995 | Latella, Jr. |
| 5,405,038 | A | | 4/1995 | Chuang |
| 5,449,079 | A | | 9/1995 | Yang |
| 5,540,557 | A | | 7/1996 | Carson |
| 5,546,997 | A | | 8/1996 | Miramon |
| 5,564,581 | A | | 10/1996 | Lin |

(Continued)

*Primary Examiner* — Fenn Mathew
*Assistant Examiner* — Jennifer Castriotta
(74) *Attorney, Agent, or Firm* — Sand & Sebolt

(57) ABSTRACT

The present invention relates to a vacuum sealable container system comprising a container and a lid assembly having a movable valve insert. The valve insert includes a vacuum indicator for informing the user when a vacuum is present in the container. The valve insert is pneumatically movable within a chamber by way of a pump assembly to open and close a fluid communication between the container and the exterior of the container to remove fluid to form the vacuum. The vacuum indicator collapses into an opening formed in the lid assembly to inform the user of the vacuum as well as reinforce the seal formed by the valve insert.

13 Claims, 10 Drawing Sheets

(56) References Cited

U.S. PATENT DOCUMENTS

| | | | | |
|---|---|---|---|---|
| 5,638,971 | A | 6/1997 | Justesen | |
| 5,692,632 | A | 12/1997 | Hsieh et al. | |
| 5,779,082 | A | 7/1998 | Miramon | |
| 5,803,282 | A | 9/1998 | Chen et al. | |
| 5,955,127 | A | 9/1999 | Glaser | |
| 5,974,686 | A | 11/1999 | Nomura et al. | |
| 6,035,769 | A | 3/2000 | Nomura et al. | |
| 6,131,753 | A | 10/2000 | Lynch | |
| 6,194,011 | B1 * | 2/2001 | Glaser | 426/123 |
| 6,675,982 | B2 | 1/2004 | Heil et al. | |
| 6,725,632 | B2 | 4/2004 | Glucksman et al. | |
| 6,789,690 | B2 | 9/2004 | Nieh et al. | |
| 6,973,945 | B2 | 12/2005 | Haimi | |
| 7,040,356 | B2 | 5/2006 | Tarlow | |
| 7,048,136 | B2 | 5/2006 | Havens et al. | |
| 7,086,427 | B2 | 8/2006 | Bonich | |
| 7,096,893 | B2 | 8/2006 | Vilalta et al. | |
| 7,131,550 | B2 | 11/2006 | Vilalta et al. | |
| 7,140,402 | B2 | 11/2006 | Russell | |
| 7,198,074 | B2 | 4/2007 | Lemme et al. | |
| 7,296,598 | B2 | 11/2007 | Lin et al. | |
| 7,325,381 | B2 | 2/2008 | Waldron | |
| 7,328,548 | B2 | 2/2008 | Waldron | |
| 7,395,942 | B2 | 7/2008 | Michalopoulos | |
| 7,527,179 | B2 | 5/2009 | Haimi | |
| 7,721,771 | B2 | 5/2010 | Tsay | |
| 7,726,354 | B2 | 6/2010 | Shlomo | |
| 7,726,355 | B2 | 6/2010 | Lemme et al. | |
| 7,931,052 | B2 | 4/2011 | Schooley | |
| 2001/0049867 | A1 | 12/2001 | Tseng | |
| 2003/0152673 | A1 | 8/2003 | Tarlow | |
| 2004/0087918 | A1 | 5/2004 | Johnson et al. | |
| 2004/0173105 | A1 | 9/2004 | Kim et al. | |
| 2005/0035021 | A1 | 2/2005 | Higer et al. | |
| 2005/0284835 | A1 | 12/2005 | McKendry et al. | |
| 2006/0032852 | A1 | 2/2006 | Cai | |
| 2006/0070971 | A1 | 4/2006 | Michalopoulos | |
| 2006/0124576 | A1 | 6/2006 | Russell | |
| 2006/0201576 | A1 | 9/2006 | Domenig | |
| 2007/0199612 | A1 | 8/2007 | Larimer et al. | |
| 2008/0035598 | A1 | 2/2008 | Simons | |
| 2009/0120831 | A1 | 5/2009 | Wang et al. | |
| 2009/0120939 | A1 | 5/2009 | Wang et al. | |
| 2010/0132831 | A1 | 6/2010 | Waroux et al. | |

* cited by examiner

VACUUM LID FOR USE WITH BABY FOOD JARS

CROSS-REFERENCE TO RELATED APPLICATION

This application claims priority from U.S. Provisional Application Ser. No. 61/536,627, filed Sep. 20, 2011, the disclosure of which is incorporated herein by reference.

BACKGROUND OF THE INVENTION

1. Technical Field

This invention relates to sealable food storage containers. More particularly, this invention relates to selectively sealing the food storage container and removing an amount of fluid from the container to keep food in the container under vacuum. Specifically, this invention relates to a food storage container having a lid assembly for removably receiving a valve insert having a vacuum indicator for visually indicating when a vacuum is present in the container.

2. Background Information

It is well known that food storage can be improved by keeping food in a container under vacuum. Keeping the food in a container under vacuum helps to prevent the food from spoiling as quickly as the food normally would under normal pressure. This is particularly important when dealing with infant food as a baby's digestive system and overall immunity has not developed to the point of having sufficient biological defenses pertaining to mildly oxidized or spoiled food. Thus, not only is it extremely important to provide a way to prevent baby food spoilage, it is also extremely important to ensure that the pieces and parts within such a container have been properly cleaned and sterilized as they may hold contaminants or particles of food which would be ingested along with the unspoiled food if the container is not properly cleaned. In addition, it is often not possible for the user to recognize when the desired vacuum is still present in the storage container. As such, a parent may believe a vacuum is present in a container when in fact the food in the container is not under vacuum.

Previous methods have been designed for keeping the food in the container under vacuum. For example, U.S. Pat. Nos. 5,195,427; 6,725,632; and 7,721,771 all propose devices using a vacuum pump for removing air pressure from a food storage container. However, the devices in this patent all are operated using a power supply for powering the vacuum pump. However, designs of this type have been found to be less desirable in that an electrical power outlet is constantly required to remove pressure from the container. Thus, it has been found that powered vacuum pumps and containers related to these devices are less desirable due to the inconvenience of powering the vacuum pump.

U.S. Pat. Nos. 5,546,997; 5,955,127; 6,035,769; 6,789,690; 7,048,136; 7,140,402; and 7,198,047 all describe food storage containers with a pressure release valve structure or method incorporated into the device for equalizing pressure within the container with respect to the outside of the container. This pressure release element allows a user to equalize pressure or release a vacuum without removing a lid from the container. However, including such a structure is costly as it adds complicated mechanical elements and materials to the overall structure of the container. Furthermore, this pressure release valve structure necessarily adds internal elements to the container itself, which increases the surface area and pockets for bacteria or other undesirable microorganisms to reside and oxidize, thus leading to quicker spoilage of the food and possible health complications. Therefore, a pressure release valve structure incorporated into a container has been shown to be an overall complicated and undesirable feature.

U.S. Pat. No. 6,675,982 describes a first valve and a second valve in the container lid for aiding in expelling air from the container. As described above, an additional valve or additional elements add to the complexity, expense, and safety to the overall container device. Thus, multiple valves within a container lid has been shown to be undesirable.

Finally, U.S. Pat. No. 6,131,753 describes another container evacuation system. This document shows a vacuum jar apparatus, including a bell jar and a vacuum pump lid, which both closes and seals the jar and pumps air out of the sealed jar. The lid includes a lower lid portion in the form of a sealing disk having a disk lower face covered with a sealing gasket material for extending across and sealing the jar upper rim. The lid lower portion also includes a downwardly extending circumferential lip for receiving the jar upper rim to center the lid on the jar. The vacuum jar apparatus of this document further includes a pumping mechanism for evacuating air in the form of either a wedge-shaped box having check valves and which permits air to be drawn from within the jar and exit the wing structure as a user turns the lid. A user wishing to permit air to enter the jar so that the lid can be removed from the jar pulls a finger engaging ring upward to sufficiently pull a cable taut, which then pulls the connected valve wall upward to emit air outside the apparatus through a vacuum release passageway into the jar. While this overall lid structure is encased in an outer shell, shown in FIG. 1, the internal mechanisms are elaborate and complex. As such, as described above, this complex valve mechanism coupled with a pressure release system is undesirable.

BRIEF SUMMARY OF THE INVENTION

The present invention relates to a vacuum sealable container system comprising: a container having a rim portion and a storage portion adapted to receive and store foodstuffs therein; a lid assembly having a base portion, wherein the lid assembly is removably attachable to the rim portion; an opening defined by the base portion; a valve wall proximate the opening and defining a pair of apertures therethrough; a seat defined by the base portion and the valve wall; a valve insert having a pair of tabs, wherein the valve insert is removably secured in the seat by each tab extending into the corresponding aperture, wherein the valve insert is movable within the seat between and open position and a closed position, and wherein the valve insert forms a seal on the opening when the valve insert is in the closed position; a vacuum indicator on the valve insert, wherein the vacuum indicator is adapted to move into the opening to reinforce the seal when a vacuum is present in the storage portion and the valve insert is in the closed position; and a removable pump assembly connectable with the lid, wherein the pump assembly is configured to simultaneously draw the valve insert into the open position while withdrawing fluid from the storage portion through the opening to create the vacuum in the storage portion; and wherein the valve insert moves into the closed position when the pump assembly ceases to withdraw fluid from the storage portion.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
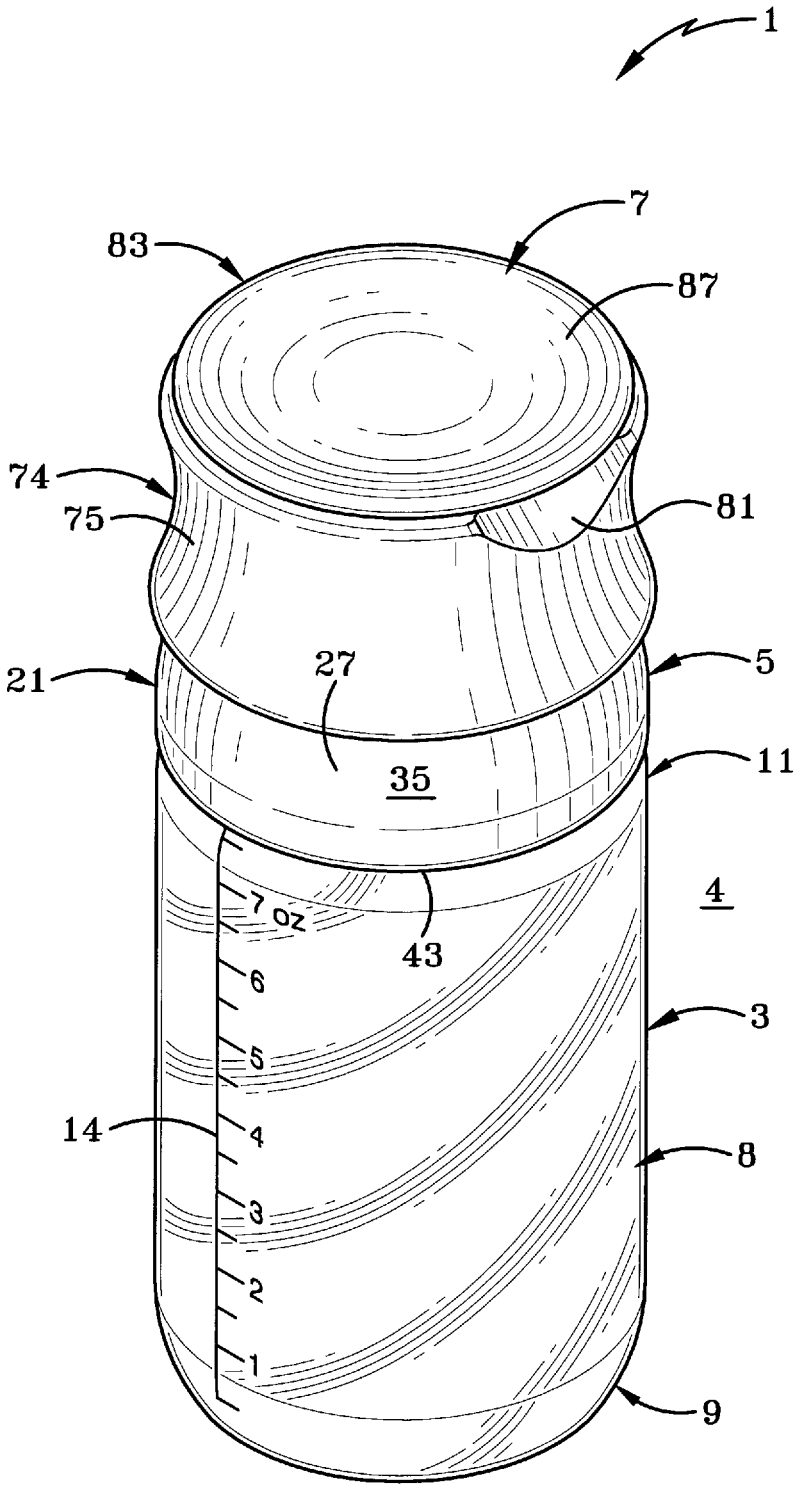
FIG. 1 is a perspective view of the food storage container having the lid and vacuum pump attached thereto.
Figure 2:
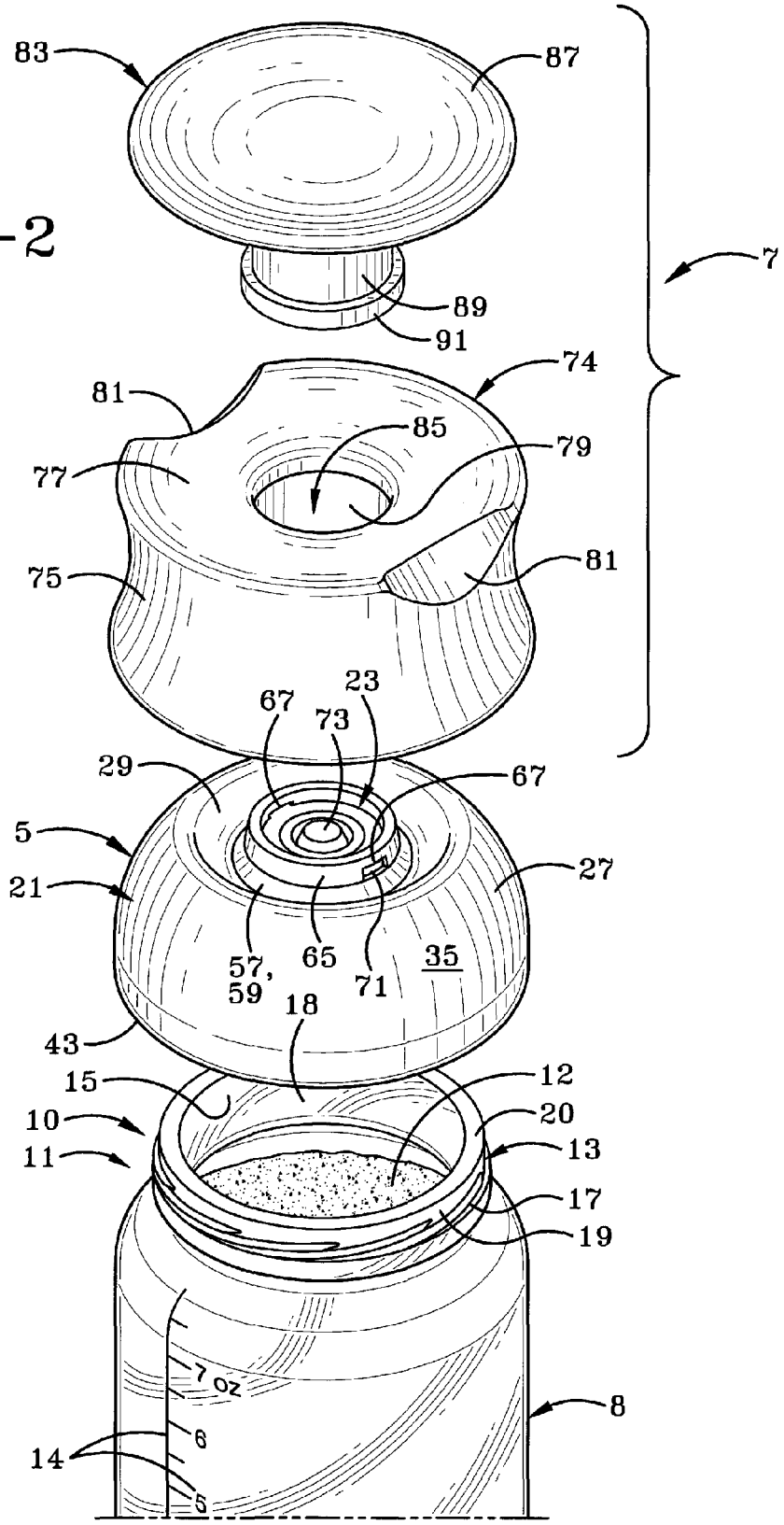
FIG. 2 is an exploded perspective view thereof.
Figure 3:
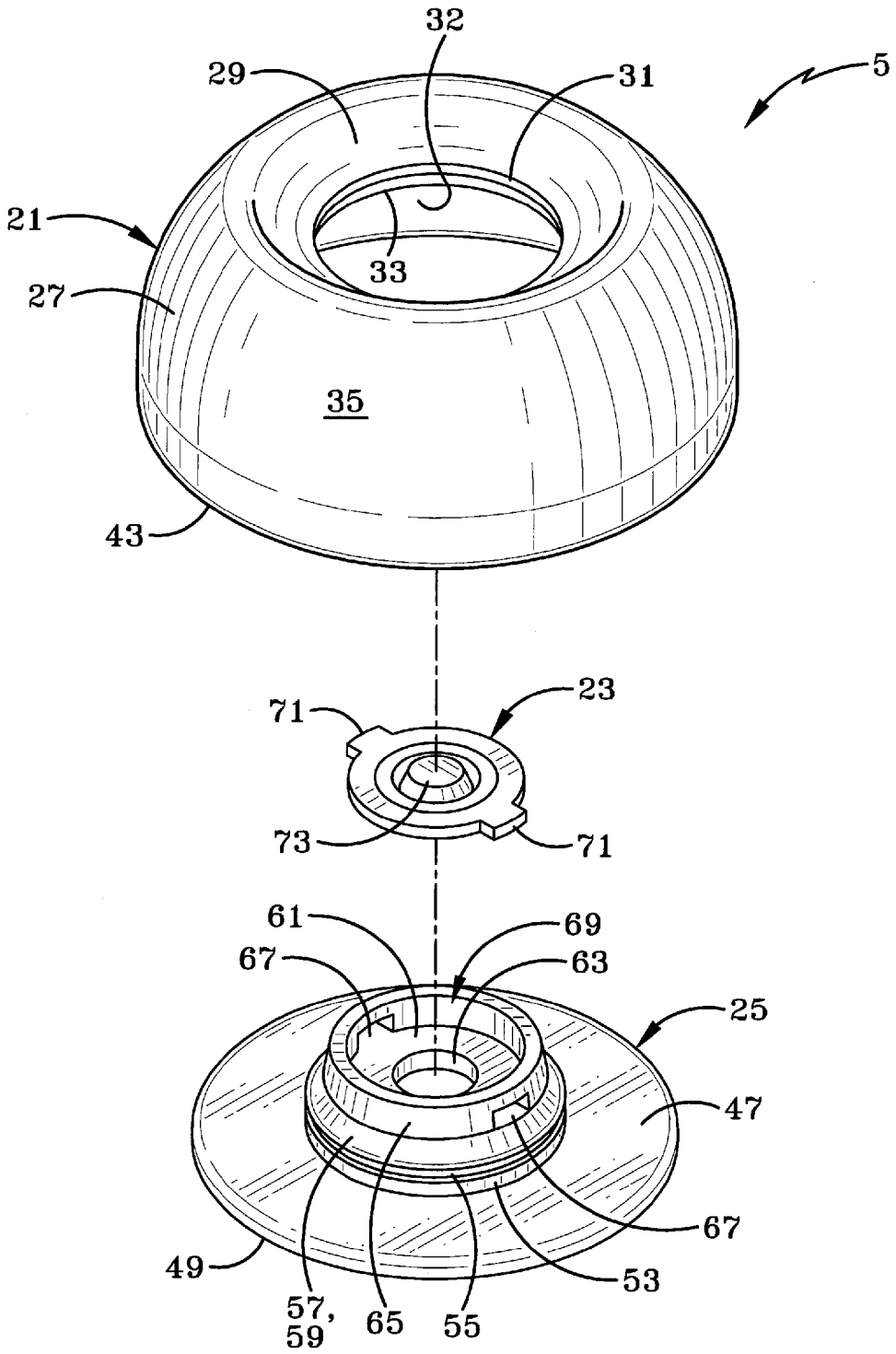
FIG. 3 is an exploded perspective view of the lid of the present invention.
Figure 4:
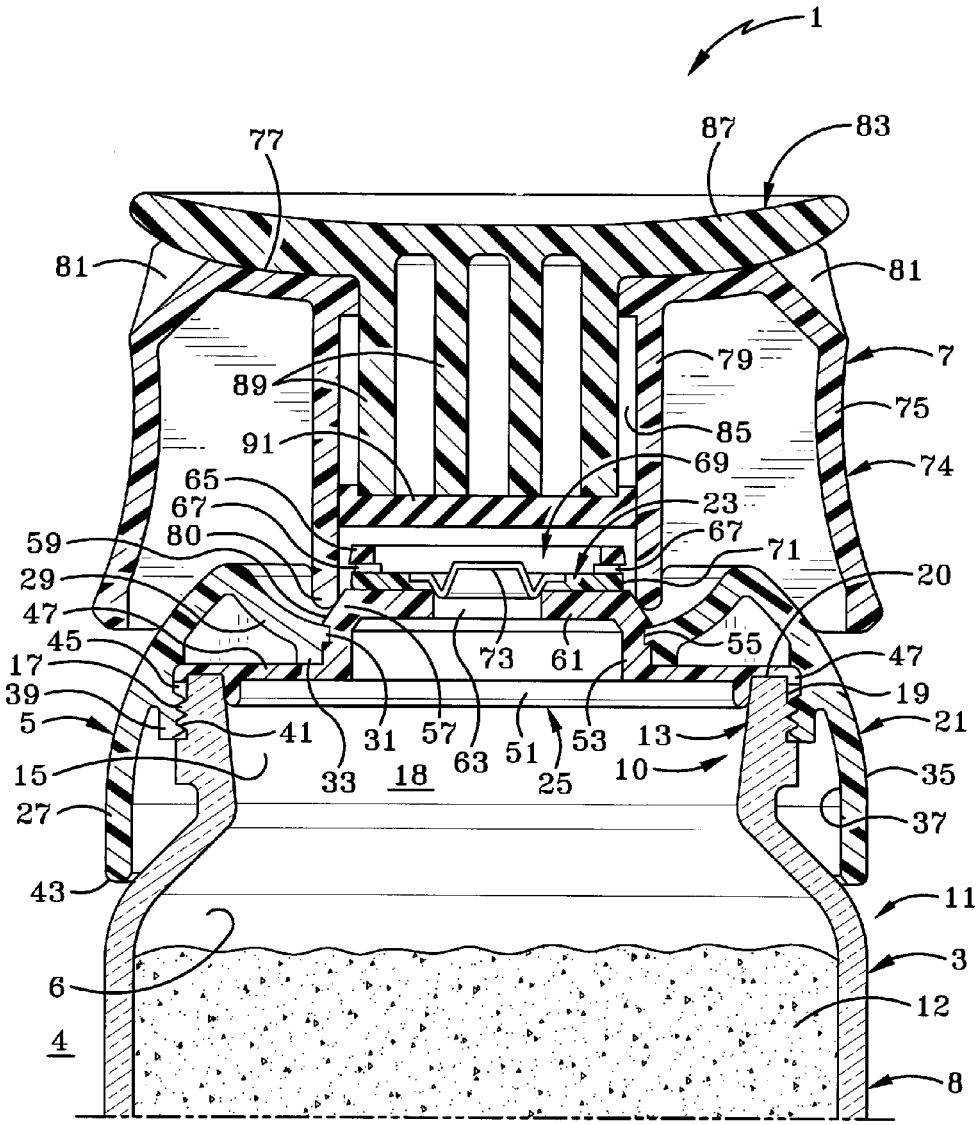
FIG. 4 is a cross sectional view of the upper end of the food storage container, the lid, and the vacuum pump having the handle in the down position.

The food storage device of the present invention is shown in FIGS. 1-10 and is indicated generally at 1. As shown in FIGS. 1, 2, and 4, food storage device 1 is generally comprised of three main elements, a container 3, a lid assembly 5, and a pump assembly 7.

Container 3 extends from a lower end 9 to an upper end 11, and generally includes a storage portion 8, a rim portion 10, an exterior 4 and an interior 6. Rim portion 10 includes an annular lip 13 disposed proximate upper end 11. Annular lip 13 defines a container opening 15, whereby an amount of food 12 may be placed therethrough to fill storage portion 8 of container 3. Rim portion 10 further includes a plurality of threads 17 disposed on an outer surface 19 extending outwardly away therefrom. Outer surface 19 runs generally perpendicularly around the periphery of a generally flat upper surface 20. As commonly used in the art, a set of indicia 14 or other graduated markings may be displayed on a portion of container 3 to indicate the amount of food 12 contained therein. An inner surface 18 extends downwardly from upper surface 20 on annular lip 13 towards storage portion 8 of container 3.

As shown in FIGS. 3 and 4, lid assembly 5 is comprised of three main parts, an outer cap 21, a valve insert 23, and a base portion 25. The exterior of outer cap 21 is formed in a general dome or skirt-like shape, with an outer wall 27 extending outwardly and downwardly from an inner wall 29 which terminates and forks into a horizontal lip 31 and a vertical lip 33. As shown in FIG. 3, inner wall 29 and horizontal lip 31 define an opening 32. Outer wall 27 includes an outer surface 35 and an opposed inner surface 37. An attachment flange 39 extends outwardly away from inner surface 37 and defines a plurality of thread receiving recesses 41 which are aligned and generally complementary formed to receive threads 17 on container 3. Outer surface 35 complements the exterior shape of container 3 along the longitudinal direction by tapering downwardly to generally align in parallel with container 3 proximate a lower end 43 of outer wall 27. A pocket 45 is defined where outer wall 27 and attachment flange 39 meet.

As shown in FIGS. 3 and 4, base portion 25 includes a back wall 47 having a first annular flange 49 and a second annular flange 51 extending outwardly away therefrom. First annular flange 49 extends into pocket 45 when base portion 25 and outer cap 21 are connected to rim portion 10. Likewise, second annular flange 51 firmly abuts inner surface 18 when base portion 25 is connected to rim portion 10. Thus, first annular flange 49 and second annular flange 51 removably secure base portion 25 to outer cap 21.

Base portion 25 further includes large annular wall 53 extending upwardly from back wall 47 and having an notch 55 defined therein, formed to mate and receive horizontal lip when base portion 25 and outer cap 21 are connected. Base portion 25 further includes an angled wall 57 extending from large annular wall 53 and having a cam surface 59 and a front wall 61 which defines an opening 63 therein. A valve wall 65 extends upwardly from front wall 61 and includes a pair of apertures 67 therethrough. Front wall 61 and valve wall 65 define a seat 69 therebetween and generally aligned with opening 63.

Figure 6:
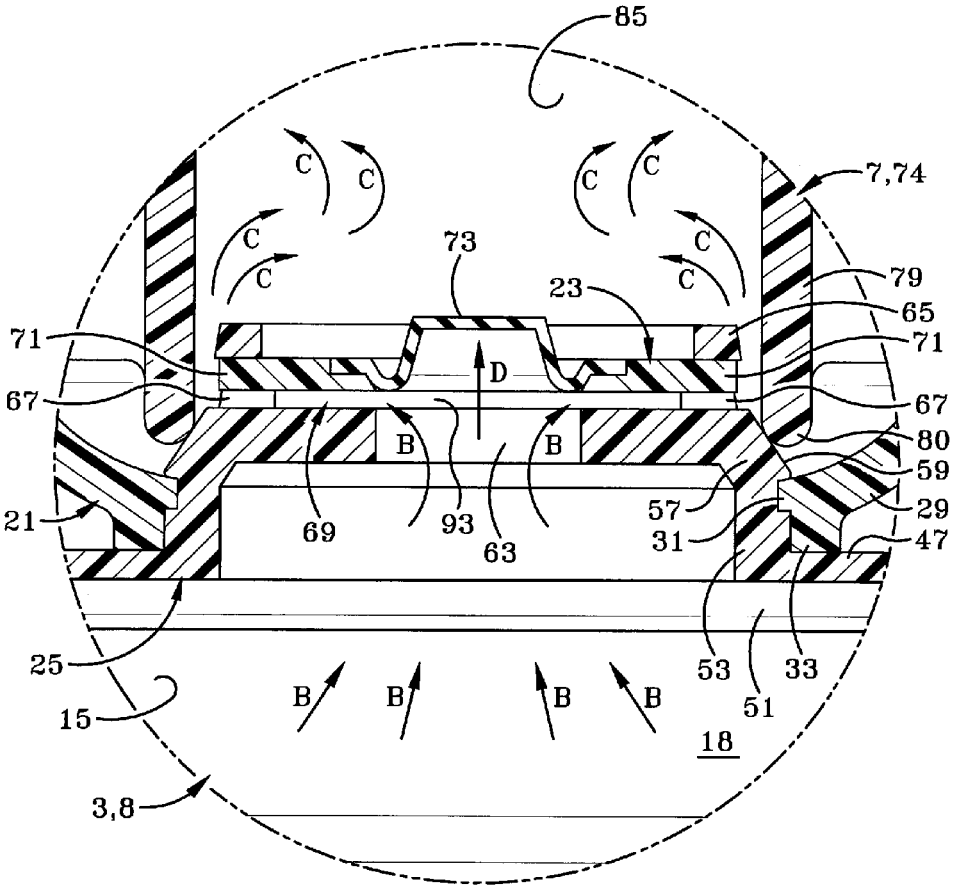
FIG. 6 is an enlarged view of the area indicated in FIG. 5.

Lid assembly 5 includes valve insert 23, shown particularly in FIGS. 3, 4, and 6. Valve insert 23 includes a pair of tabs 71, wherein valve insert 23 is removably secured in seat 69 by each tab 71 extending into the corresponding aperture 67. Valve insert 23 further includes a vacuum indicator 73, which may be made from a flexible elastomeric material. Vacuum indicator 73 is movable within valve insert 23 from an up position or default state (FIG. 6) to a down position or depressed state (FIG. 7) to indicate when a vacuum is present in storage portion 8. Vacuum indicator 73 is generally similar in shape to opening 63, wherein when vacuum indicator 73 is in the down position, at least a portion of vacuum indicator may extend into opening 63.

Figure 5:
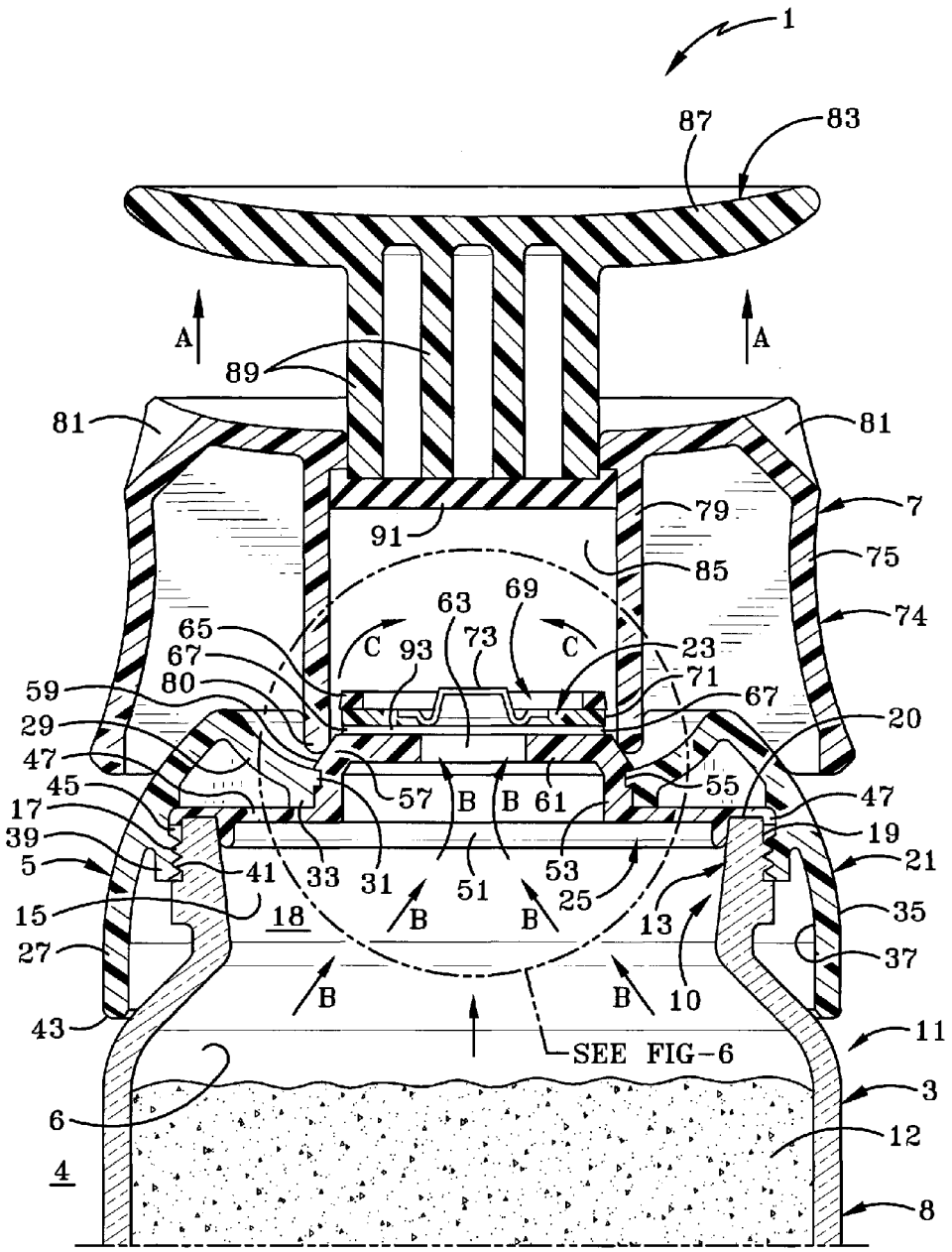
FIG. 5 is a similar view to FIG. 4, however the handle of the pump is in the up position.

As shown in FIGS. 4, 5, and 6, pump assembly 7 is removably connectable with lid assembly 5, generally about angled wall 57 and valve wall 65. Pump assembly 7 includes an outer wall 75, an inner wall 79, and a top wall 77 extending therebetween to connect outer wall 75 and inner wall 79. A pair of grip cutouts 81 are disposed at the intersection of outer wall 75 and top wall 77, whereby outer wall 75 angled inward slightly to disrupt the vertical nature of outer wall 75 and create an area for the user to grip pump assembly 7. Inner wall 79 extends from top wall 77 downwardly to a lower portion 80. Lower portion 80 is sized to abut cam surface 59 of angled wall 57 when pump assembly 7 is connected with lid assembly 5. Thus, the entirety of inner wall 79, or lower portion 80 in particular, may be formed of an elastomeric or non-ridged material for facilitating elastic abutment between lower portion 80 and cam surface 59. Inner wall 79 defines a chamber 85 therebetween.

Figure 7:
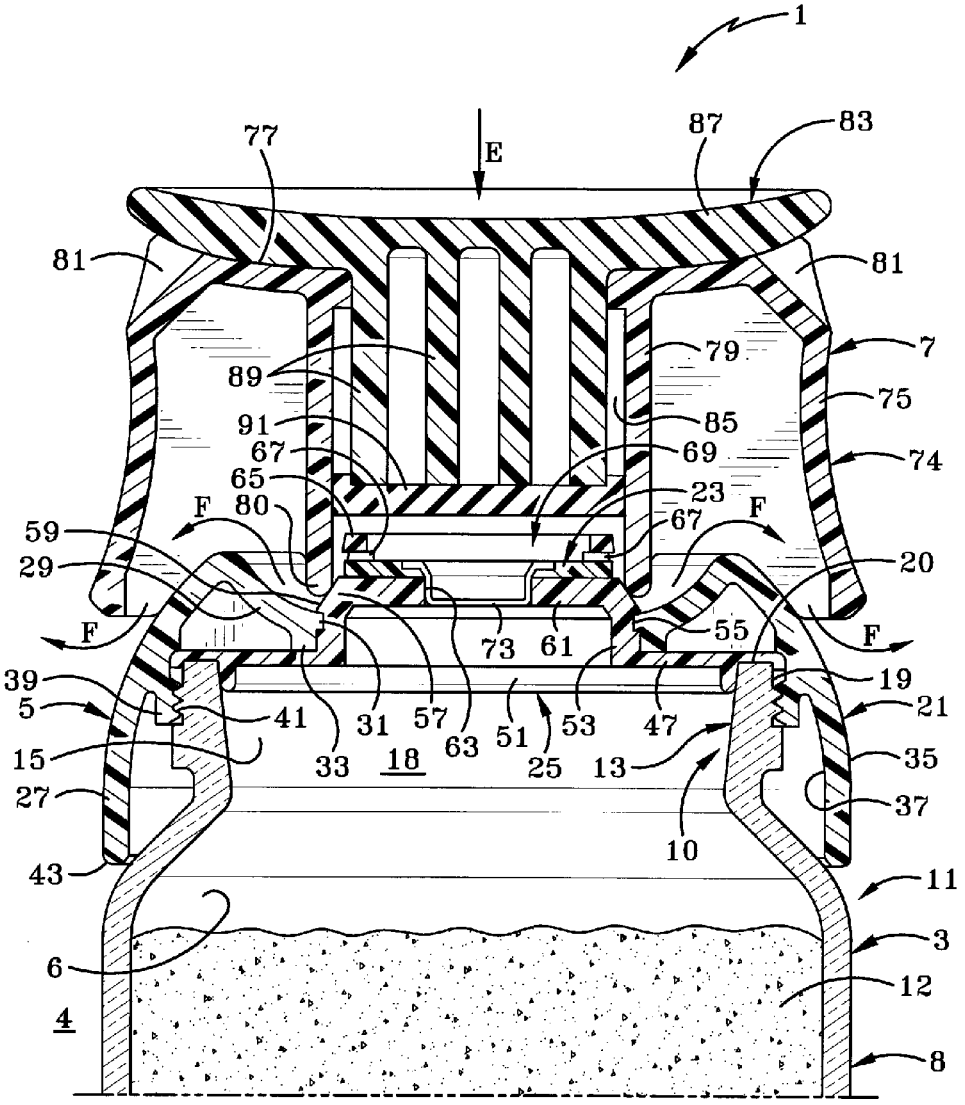
FIG. 7 is a cross sectional view of the upper end of the food storage container, the lid, and the vacuum pump having the handle in the down position.

Pump assembly 7 further includes a piston assembly 83. Piston assembly 83 includes a handle 87 connected to a stopper 91 by a series of shafts 89 extending therebetween. Stopper 91 is movable within chamber 85 and is sized and configured to firmly abut inner wall 79 to prevent fluid or air from moving past stopper 91 towards shafts 89. Piston assembly 83 is movable between an up position (FIG. 5) and a down position (FIG. 7). As piston assembly 83 moves from the down position to the up position, fluid is pulled into chamber 85 as stopper 91 recedes from chamber 85. Likewise, as piston assembly 83 moves from the up position to the down position, fluid is expelled from chamber 85 as stopper 91 plunges through chamber 85 from proximate top wall 77 to proximate lower portion 80 of inner wall 79.

The method of forming a vacuum within storage portion 8 of container 3 is now described herein. As desired, a user places pump assembly 7 with piston assembly 83 in the down position against lid assembly 5 such that lower portion 80 of inner wall 79 firmly abuts cam surface 59 of angled wall 57.

This aligns chamber 85 with seat 69 and opening 63. As shown in FIG. 5, the user then manually pulls handle 87 in the direction of Arrow A to move piston assembly 83 from the down position to the up position. The user may position the user's fingers to grasp handle 87 conveniently at grip cutouts 81. As such, stopper 91 recedes in chamber 85, moving from proximate lower portion 80 to proximate top wall 77. As shown in FIG. 6, the receding motion of stopper 91 and the fluid-tight nature of piston assembly 83 pneumatically moves valve insert 23 within seat 69 from the closed position to the open position, in the direction of Arrow D. When valve insert 23 is in the open position, a fluid channel 93 (FIG. 6) is created, allowing fluid communication between storage portion 8 and chamber 85. In addition to pneumatically moving valve insert 23 from the closed position to the open position, the receding motion of stopper 91 further withdraws fluid from storage portion 8 into chamber 85 through fluid channel 93, as shown by Arrows B and C.

Figure 8:
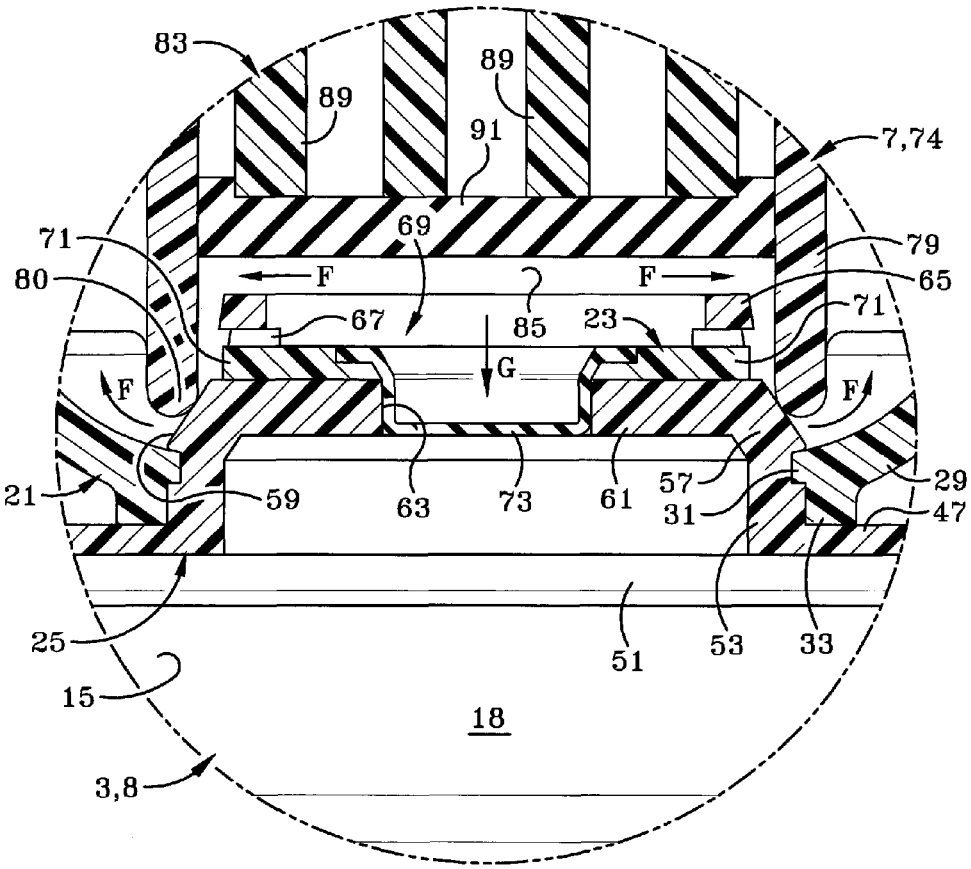
FIG. 8 is an enlarged view of the vacuum indicator.

As shown in FIGS. 7 and 8, after an effective amount of fluid has been withdrawn from storage portion 8 into chamber 85 by way of moving piston assembly 83 from the down position to the up position, the user then manually presses handle 87 in the direction of Arrow E. As piston assembly 83 moves from the up position to the down position, valve insert 23 pneumatically moves from the open position to the closed position due to the vacuum within storage chamber 8 and the fluid pressure from piston assembly 83. This movement of valve insert 23 to the closed position effectively seals off storage portion 8 from chamber 85 and closes fluid channel 93 to prevent fluid communication between storage portion 8 and chamber 85. As a consequence, a vacuum is formed in storage portion 8. In addition to pneumatically moving valve insert 23 from the open position to the closed position, the motion of stopper 91 further expels fluid from chamber 85. Inasmuch as fluid channel 93 is closed as valve insert 23 moves from the open position to the closed position, the fluid in chamber 85 is expelled in the direction of Arrows F. As shown in FIG. 8, fluid is pushed out of piston assembly 83 at the junction between lower portion 80 and cam surface 59.

It is a primary feature of the present invention that when a vacuum is formed in storage chamber 8 by way of the above method, vacuum indicator 73 moves from the up position or default state (FIG. 6) to a down position or a depressed state (FIG. 7) to indicate when a vacuum is present in storage portion 8. As shown in FIG. 8, vacuum indicator 73 moves in the direction of Arrow G to move into opening 63. While this movement into opening 63 provides visual indication to the user that a vacuum is formed in storage portion 8, vacuum indicator 73 also occludes opening 63 such that the seal between valve insert 23 and lid assembly 5 is reinforced. Thus, it is a primary feature of the present invention that vacuum indicator 73 not only provides a visual indication to a user that a vacuum is present in storage chamber 8, vacuum indicator 73 further provides a structure reinforce opening 73 and the overall seal between valve insert 23 and lid assembly 5.

Figure 9:
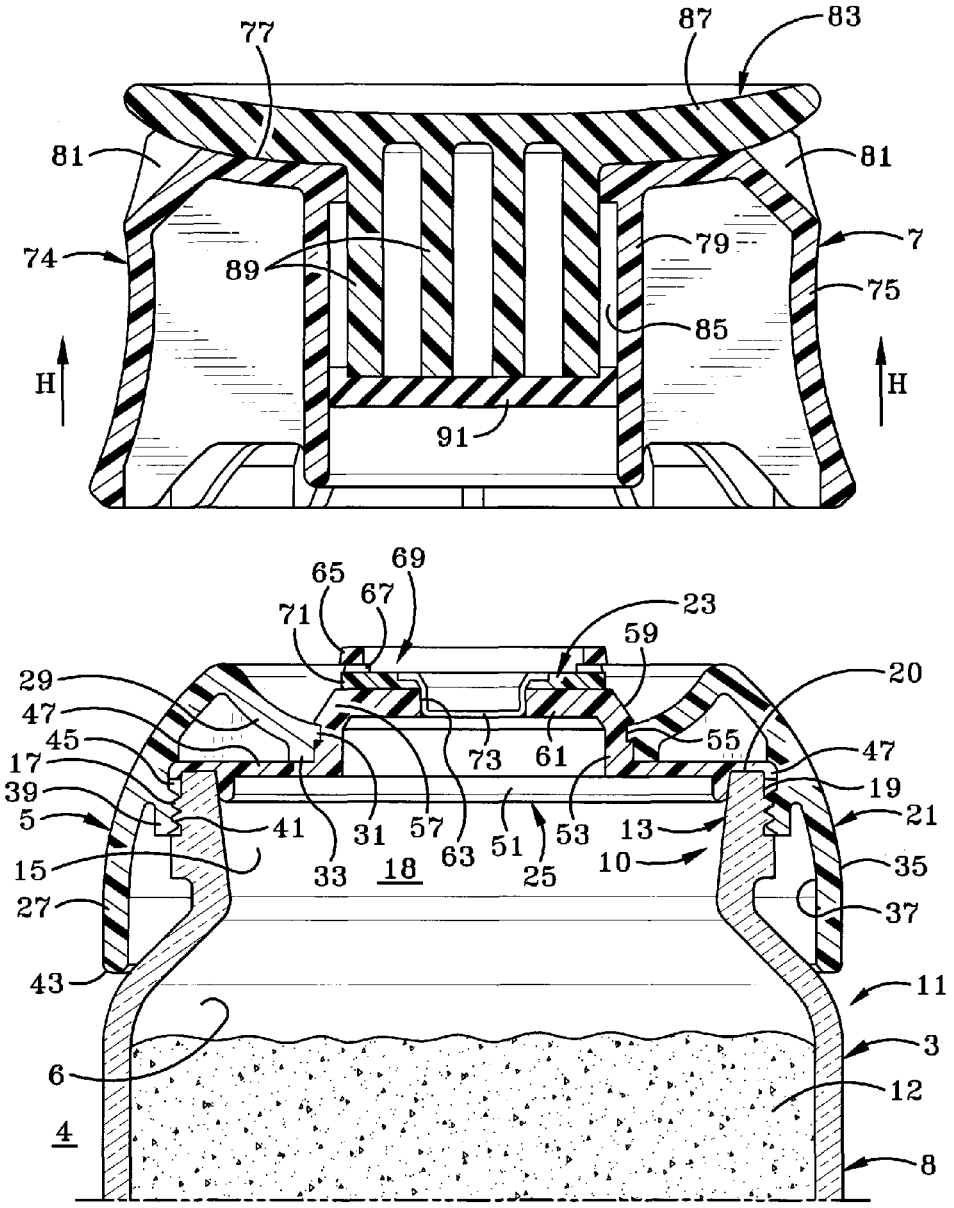
FIG. 9 is a cross sectional elevational view shown with the pump disconnected from the lid.
Figure 10:
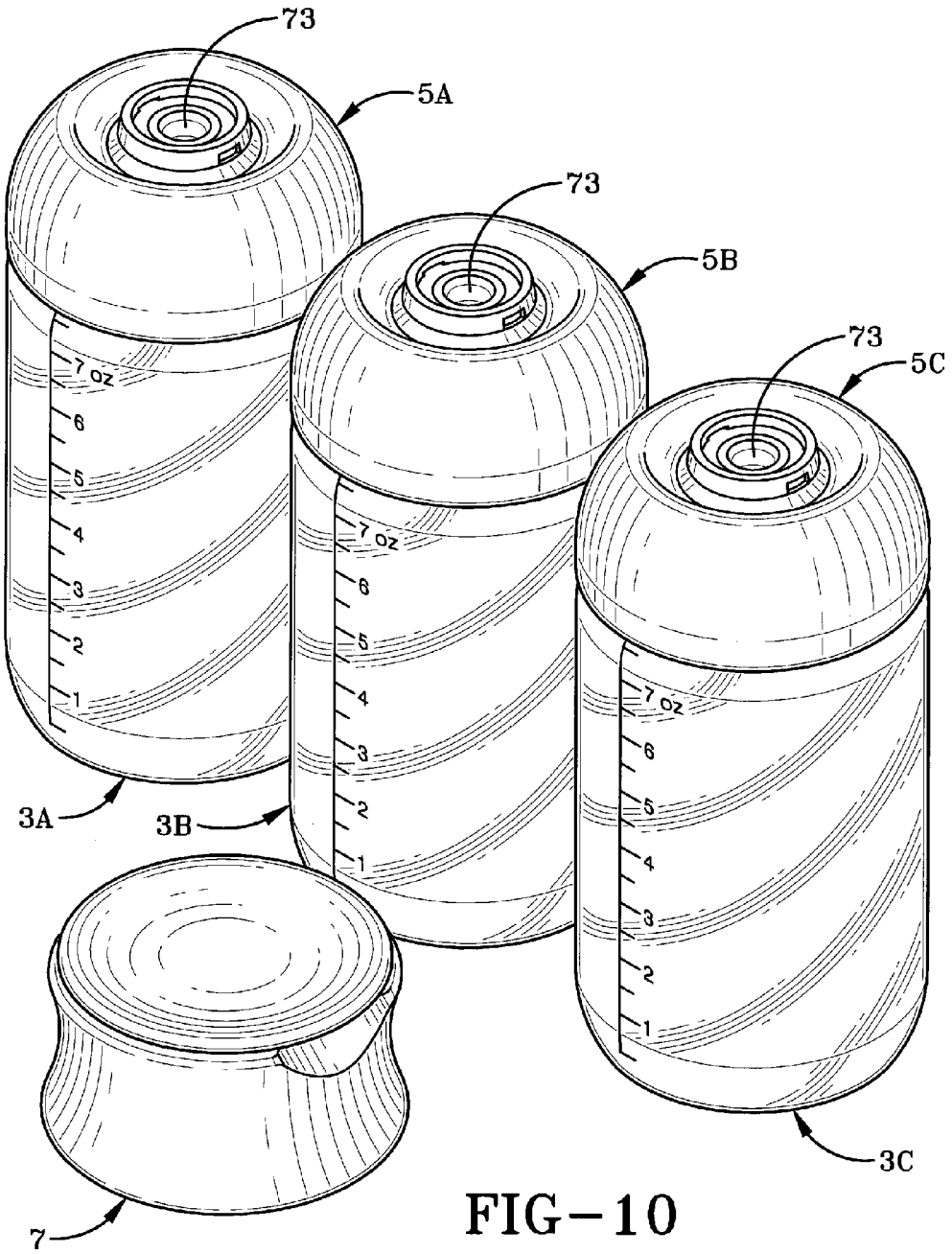
FIG. 10 is a perspective view of three food storage containers having lids attached and a vacuum indicator in the down position.

As shown in FIG. 9, after a vacuum is formed in storage chamber 8, pump assembly 7 may be withdrawn in the direction of Arrow H to remove pump assembly 7 from container 3 and lid assembly 5. Thus, pump assembly 7 is free to form a vacuum in other containers or for storage and later use. As shown in FIG. 10, several containers 3A, 3B, 3C, and several lid assemblies 5A, 5B, 5C, respectively, may be utilized at one time, while reusing a single pump assembly 7.

Inasmuch as food particles may reside or become trapped in pockets or hard to clean areas within food storage container 1, it is another primary feature of the present invention that valve insert 23 may be removed from seat 69, and base portion 25 may be removed from outer cap 21. As shown in FIGS. 3 and 4, tabs 71 of valve insert 23 allow a user to pinch or deform valve insert 23 to withdraw tabs 71 from apertures 67, thereby releasing valve insert from base portion 25. Likewise, the press-fit connection between outer cap 21 and base portion 25 allow horizontal lip 31 to be removed from notch 55, and first annular flange 49 to be removed from pocket 45 to release base portion 25 from outer cap 21. After valve insert 23 is separated from base portion 25, and base portion 25 is separated from outer cap 21, the user may then conveniently wash these individual elements separately to remove food particles more thoroughly.

Conversely, after outer cap 21, valve inset 23, and base portion 25 are separated and cleaned, these elements are easily re-assembled to form lid assembly 5. A user grasps valve insert 23 and pinches the overall shape to bend tabs 71 inward. This allows the user to place valve insert 23 to into seat 69. As valve insert 23 is released, tabs 71 move into apertures 67 to secure valve inert 23 into seat 69. As shown in FIGS. 3 and 4, after valve insert 23 is secured to base portion 25, the user aligns base portion 25 and outer cap 21 such that camming surface 59 of angled wall 57 moves through opening 32 on base portion 25. The user then presses base portion 25 again outer cap 21 to dispose large annular wall 53 in opening 32. This pressing movement extends horizontal lip 31 into notch 55 and firmly abuts vertical lip 33 against back wall 47 and large annular wall 53. First annular flange 49 rides over thread receiving recesses 41 to fit into pocket 45 thereby positioning second annular flange 51 to abut inner surface 18. This firmly secures outer cap 21 and base portion 25 together for use with container 3.

Container 3 is shown as having a particular shape and size, however, any common shape of size of container 3 is encompasses by the present invention. Further, lid assembly 5 may be formed to connect with standard size "off-the-shelf" baby food jars. Thus, a user can connect lid assembly 5 to standard baby food jars and practice the inventive features of the present invention therewith. After use, the standard baby food jars may be discarded and a new standard baby food jar may be connected to lid assembly 5. Thus, it is another primary feature of the present invention that lid assembly 5 may be sized to fit onto standard size off-the-shelf baby food jars.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a container having a rim portion and a storage portion adapted to receive and store foodstuffs therein;

a lid assembly having a base portion, wherein the lid assembly is removably attachable to the rim portion;

an opening defined by the base portion;

a valve wall proximate the opening;

a seat defined by at least one of the base portion and the valve wall;

a valve insert, wherein the valve insert is removably secured in the seat and movable within the seat between an open position and a closed position, and wherein the valve insert forms a seal on the opening when the valve insert is in the closed position; and a vacuum indicator for indicating whether a vacuum exists in the container, wherein the vacuum indicator is movable between a first state when the vacuum is not present and a second state when the vacuum is present; and a pair of apertures defined by the valve wall and a pair of tabs on the valve insert, wherein the valve insert is removably secured in the seat by each of the tabs extending into the corresponding aperture.

2. The apparatus of claim 1, wherein the vacuum indicator is outside the opening in the second state.

3. The container system of claim 2, wherein the vacuum indicator is configured to extend outwardly away from the opening in the first state.

4. The container system of claim 3, wherein the vacuum indicator is formed from a flexible elastomeric material.

5. The container system of claim 3, wherein valve insert and the vacuum indicator is an integrated one-piece member formed from a single mold.

6. The apparatus of claim 1, further comprising a removable pump assembly connectable with the lid, wherein the pump assembly is configured to draw the valve insert into the open position while simultaneously withdrawing fluid from the storage portion through the opening to create the vacuum in the storage portion.

7. The apparatus of claim 6, wherein the valve insert moves into the closed position when the container achieves a predetermined vacuum level.

8. The container system of claim 6, further comprising a piston assembly on the pump assembly, wherein the piston assembly is movable between an up position and a down position.

9. The container system of claim 8, wherein the piston assembly pneumatically draws the valve insert into the open position when the piston assembly moves from the down position to the up position.

10. The container system of claim 9, wherein the piston assembly pneumatically presses the valve insert into the closed position when the piston assembly moves from the up position to the down position.

11. An apparatus comprising:

a container having a rim portion and a storage portion adapted to receive and store foodstuffs therein;

a lid assembly having a base portion, wherein the lid assembly is removably attachable to the rim portion;

an opening defined by the base portion;

a valve wall proximate the opening;

a seat defined by at least one of the base portion and the valve wall;

a valve insert, wherein the valve insert is removably secured in the seat and movable within the seat between an open position and a closed position, and wherein the valve insert forms a seal on the opening when the valve insert is in the closed position;

a vacuum indicator for indicating whether a vacuum exists in the container, wherein the vacuum indicator is movable between a first state when the vacuum is not present and a second state when the vacuum is present; and an outer cap removably secured to the base portion and having a plurality of lid threads for engaging a plurality of rim threads formed on the rim portion to removably attach the lid assembly to the rim portion.

12. The system of claim 11 further comprising at least one aperture defined by the valve wall, wherein the valve insert is removably secured in the seat by a corresponding at least one portion of the valve insert extending into the at least one aperture.

13. The system of claim 11 further comprising a pair of apertures defined by the valve wall and a pair of tabs on the valve insert, wherein the valve insert is removably secured in the seat by each of the tabs extending into the corresponding aperture.

* * * * *